US006655821B1

(12) United States Patent
Tai

(10) Patent No.: US 6,655,821 B1
(45) Date of Patent: Dec. 2, 2003

(54) QUICK ENGAGING DEVICE FOR CONNECTING LAMP SHADE TO CONNECTION PORT OF CEILING FAN

(76) Inventor: Chun Ya Tai, 9F, No. 92, Jing-Cheng Road, Taichung City (TW)

( * ) Notice: Subject to any disclaimer, the term of this patent is extended or adjusted under 35 U.S.C. 154(b) by 0 days.

(21) Appl. No.: 10/166,786

(22) Filed: Jun. 11, 2002

(51) Int. Cl.[7] ..... F21V 11/00

(52) U.S. Cl. ..... 362/353; 362/226; 362/439; 362/430; 362/453; 362/437; 362/375; 362/433

(58) Field of Search ..... 362/353, 351, 362/226, 433, 439, 430, 453, 437, 363, 375

(56) References Cited

U.S. PATENT DOCUMENTS 512,364 A * 1/1894 Cooke ..... 362/353

5,560,707 A * 10/1996 Neer ..... 362/376

* cited by examiner

*Primary Examiner*—Stephen Husar
*Assistant Examiner*—Sharon Payne
(74) *Attorney, Agent, or Firm*—Charles E. Baxley

(57) ABSTRACT

A lamp connection port connected to a ceiling fan assembly includes an open end which is enclosed by a skirt portion of the connection port. A plurality of flexible protrusions extend inward from an inside of the skirt portion and a first end of a lamp shade is engaged in the open end of the lamp connection port. The first end of the lamp shade has a flange and a groove is defined in an outer periphery of the lamp shade. The flexible protrusions are engaged with the groove of the lamp shade.

5 Claims, 5 Drawing Sheets

QUICK ENGAGING DEVICE FOR CONNECTING LAMP SHADE TO CONNECTION PORT OF CEILING FAN

FIELD OF THE INVENTION

The present invention relates to a lamp connection port of a ceiling fan and a lamp shade wherein the connection port has flexible inward protrusions which are able to be quickly engaged with a groove defined in an outer periphery of the lamp shade.

BACKGROUND OF THE INVENTION

A conventional ceiling fan assembly generally includes a motor casing with a motor received therein and a shaft driven by the motor extends from the bottom of the motor casing so as to connect the blades of the ceiling fan. In order to provide illumination feature, several lamp connection ports extend outward from the motor casing so that each lamp connection port is connected to a lamp shade. In order to fix the lamp shades to the lamp connection ports, screws are used to extend through the lamp connection ports and to securely position the lamp shades. However, each connection port requires at least three screws so as to effectively position the lamp shade and this takes a lot of time to install the screws one by one. Furthermore, vibration and shaking of the ceiling fan may loosen the screws and result in noise due to the impact between the lamp connection ports and the lamp shades.

The present invention intends to provide a quick engaging device that needs no screws and can be assemble the lamp shades to the lamp connection ports easily and quickly.

SUMMARY OF THE INVENTION

In accordance with one aspect of the present invention, there is provided an assembly of a lamp connection port and a lamp shade The lamp connection port comprises an open end which is enclosed by a skirt portion and a plurality of flexible protrusions extend inward from an inside of the skirt portion. The lamp shade has a flange on a first end thereof and a groove is defined in an outer periphery of the lamp shade. The first end of the lamp shade is engaged with the open end of the lamp connection port and the flexible protrusions are engaged with the groove of the lamp shade.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
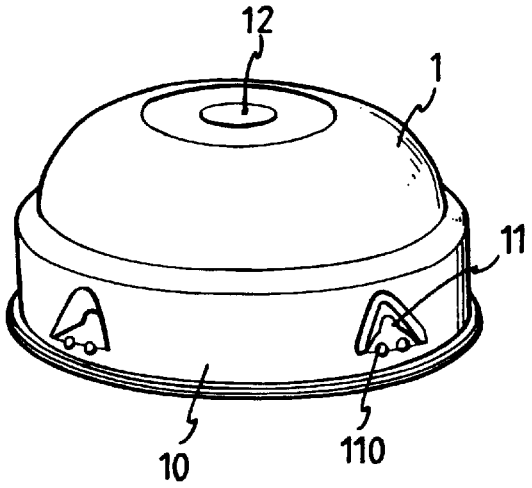
FIG. 1 is a perspective view to show the lamp connection port of the present invention.
Figure 2:
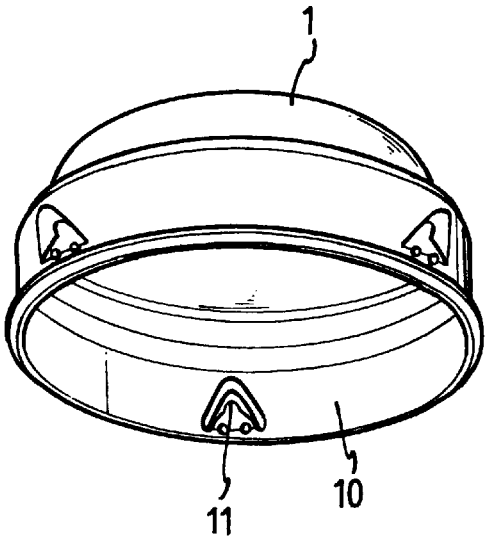
FIG. 2 is a bottom perspective view to show the lamp connection port of the present invention.

Referring to FIGS. 1 and 2, the lamp connection port 1 of the present invention is connected to a ceiling fan assembly (not shown) and comprises a close end through which a hole 12 is defined for electric wires extending therethrough, and an open end which is enclosed by a skirt portion 10. A plurality of flexible protrusions 11 are formed by punching the material of the skirt portion 10 so as to form the flexible protrusions 11 extending inward from an inside of the skirt portion 10. Two welding reinforcements 110 are located at the folding portion of each of the flexible protrusions 11 so as to prevent the flexible protrusions 11 from being broken when in use.

Figure 3:
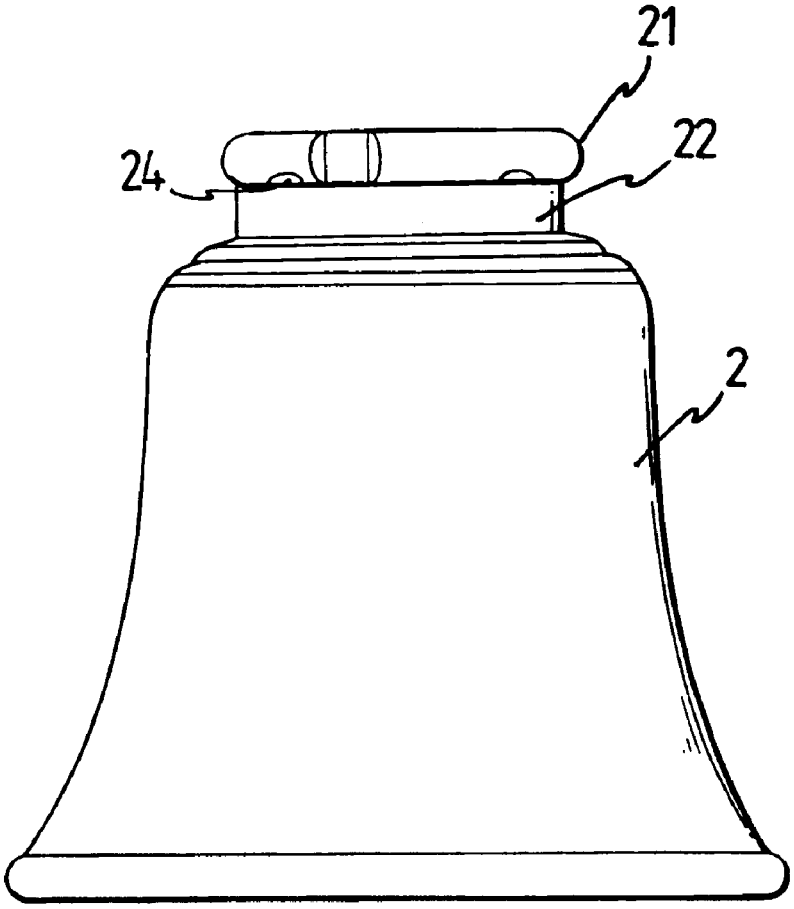
FIG. 3 is a side view to show the lamp shade of the present invention.
Figure 4:
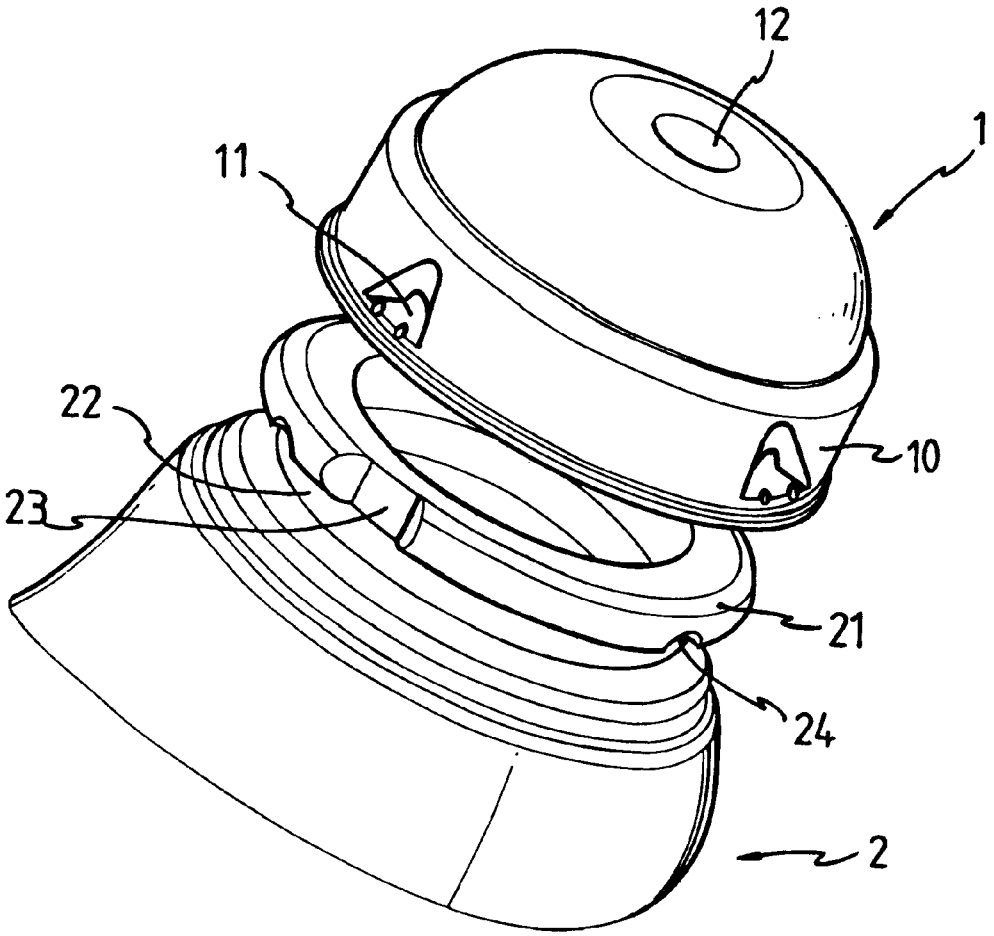
FIG. 4 shows that the lamp connection port is to be engaged with the lamp shade of the present invention.

As shown in FIG. 3, the lamp shade 2 has a flange 21 on a first end thereof and a groove 22 is defined in an outer periphery of the lamp shade 2 and located below the flange 21. A plurality of positioning notches 24 are defined in the flange 21 and communicate with the groove 22. The first end of the lamp shade 2 is engaged with the open end of the lamp connection port 1 and the flexible protrusions 11 are then engaged with the groove 22 of the lamp shade 2 as shown in FIG. 4. The flexible protrusions 11 are engaged with the positioning notches 24 so as to ensure that the connection of the lamp shade 2 and the lamp connection port 1 is secured. By this way, no screws are needed and the lamp shade 2 can be easily and quickly connected to the lamp connection port 1.

A notch 23 is defined in the flange 21 and communicates with the groove 22. The notch 23 has an enlarged opening defined in an outer periphery of the flange 21. When installing the lamp shade 2 in the lamp connection port 1, two protrusions 11 are firstly engaged with the groove 22 and the third protrusion 11 can be easily engaged with the groove 22 via the notch 23.

Figure 5:
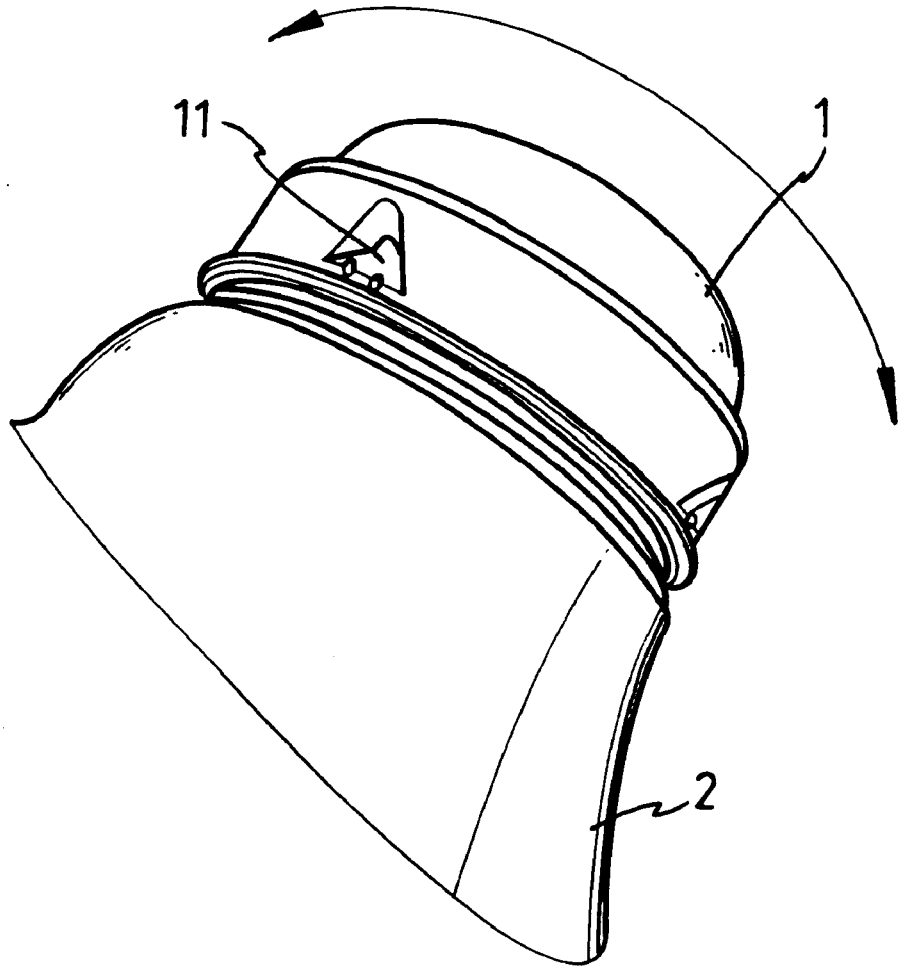
FIG. 5 shows that the lamp connection port is rotated an angle when the lamp shade is engaged with the lamp: connection port.

As shown in FIG. 5, after the flexible protrusions 11 are engaged with the groove 22, the flexible protrusions 11 are rotated an angle to shift the third flexible protrusions 11 not to be located in alignment with the notch 23.

Figure 6:
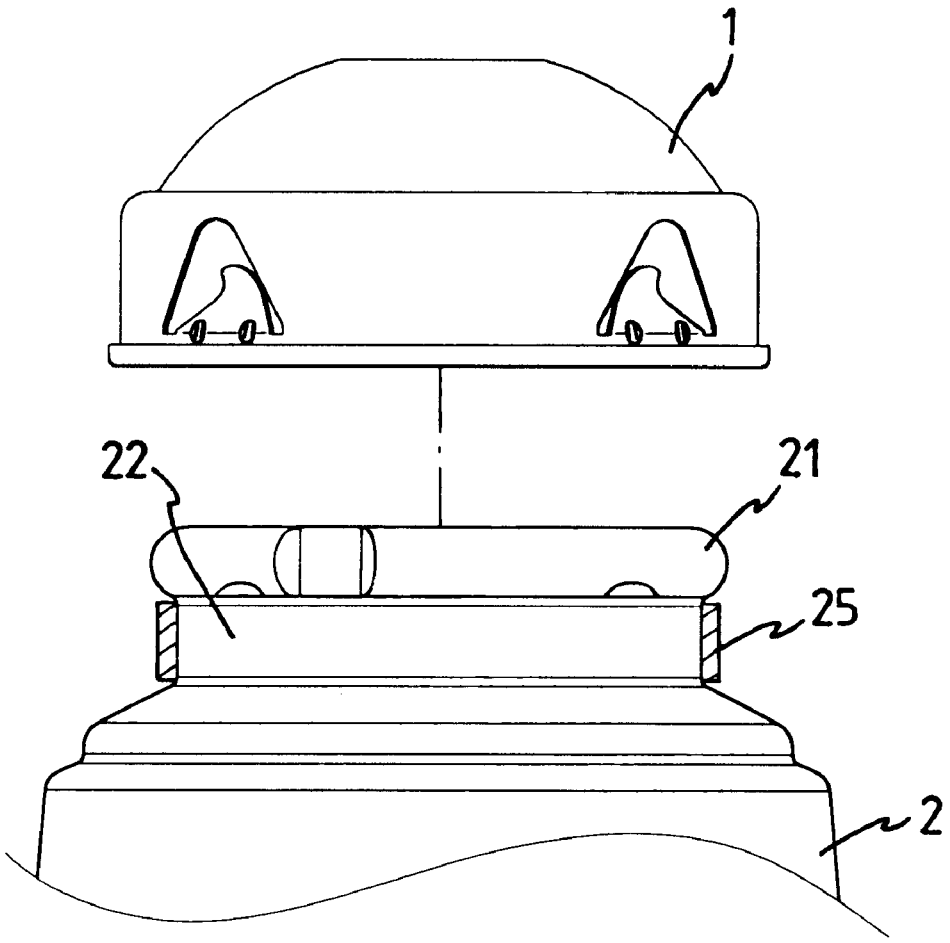
FIG. 6 shows a noise absorbing bend engaged with the groove in the lamp shade.

As shown in FIG. 6, a noise absorbing bend 25 is received in the groove 22 and located between the protrusions 11 and the lamp shade 2. The noise absorbing bend 25 absorbs the impact between the lamp shade 2 and the flexible protrusions 11 to reduce the noise when the ceiling fan is in operation. Three holes are defined through the skirt portion 10 of the lamp connection port 1 due to the punching of the protrusions 11 are advantageous for releasing heat of the lamp shade 2.

While we have shown and described the embodiment in accordance with the present invention, it should be clear to those skilled in the art that further embodiments may be made without departing from the scope of the present invention.

What is claimed is:

1. An assembly of a lamp connection port and a lamp shade, the lamp connection port comprising an open end which is enclosed by a skirt portion, a plurality of flexible protrusions extending inward from an inside of the skirt portion, and the lamp shade having a flange on a first end thereof and a groove defined in an outer periphery of the lamp shade, the first end of the lamp shade engaged with the open end of the lamp connection port and the flexible protrusions engaged with the groove of the lamp shade.

2. The assembly as claimed in claim 1, wherein a notch is defined in the flange and communicates with the groove.

3. The assembly as claimed in claim 2 wherein the notch has an enlarged opening defined in an outer periphery of the flange.

4. The assembly as claimed in claim 1 further comprising a noise absorbing bend received in the groove and located between the protrusions and the lamp shade.

5. The assembly as claimed in claim 1 further comprising a plurality of positioning notches defined in the flange and communicating with the groove, the flexible protrusions engaged with the positioning notches.

* * * * *